US006641126B2

(12) United States Patent
Yang

(10) Patent No.: US 6,641,126 B2
(45) Date of Patent: Nov. 4, 2003

(54) INTEGRAL U-SHAPE CLAMPING BLOCK STRUCTURE

(76) Inventor: Tai-Her Yang, No. 59, Hsiao 8 St., Si-Hu Town, Dzan-Hwa (TW)

( * ) Notice: Subject to any disclaimer, the term of this patent is extended or adjusted under 35 U.S.C. 154(b) by 0 days.

(21) Appl. No.: 10/084,347

(22) Filed: Feb. 28, 2002

(65) Prior Publication Data

US 2003/0160373 A1 Aug. 28, 2003

(51) Int. Cl.[7] ..... B25B 1/24

(52) U.S. Cl. ..... 269/282; 269/259; 269/262; 269/271

(58) Field of Search ..... 269/259, 262, 269/282, 271, 261, 277, 279, 280, 281, 283, 284, 296, 421, 423

(56) References Cited

U.S. PATENT DOCUMENTS 2,609,717 A * 9/1952 Maroth ..... 81/38
4,437,654 A * 3/1984 Chiappetti ..... 269/283
4,717,132 A * 1/1988 Yang ..... 269/261
4,798,371 A * 1/1989 Walliser ..... 269/283
4,969,638 A * 11/1990 Yang ..... 269/261
5,145,157 A * 9/1992 Polk ..... 269/266
5,163,664 A * 11/1992 Calaio ..... 269/271
6,155,550 A * 12/2000 Sheehy ..... 269/277
6,170,813 B1 * 1/2001 Bowers ..... 269/282
6,427,995 B1 * 8/2002 Steinwall ..... 269/283

* cited by examiner

*Primary Examiner*—Joseph J. Hail, III
*Assistant Examiner*—Daniel Shanley
(74) *Attorney, Agent, or Firm*—Rabin & Berdo, P.C.

(57) ABSTRACT

An integral U-shape clamping block structure comprised of a clamping block and a fixation arm respectively extending rearward, and multiple fixation holes and screws being provided sideways on each fixation arm to be incorporated to both sides of a neck of jaw, thus to ensure the clamping strength and expanded width of a clamping surface to improve clamping capability, thus to facilitate combination or retrofit of the clamping block and the neck of jaw

2 Claims, 5 Drawing Sheets

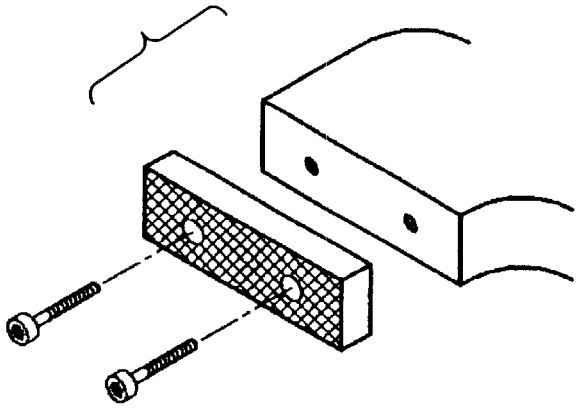
Prior Art FIG. 9
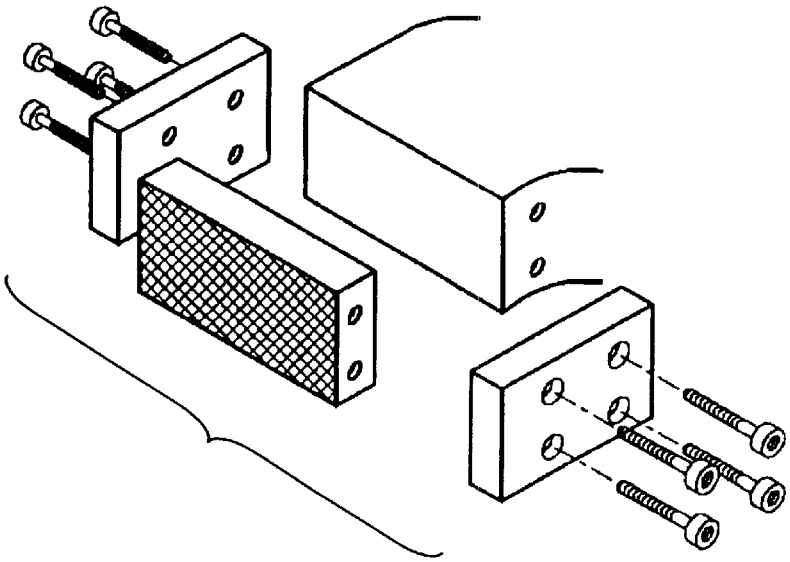
Prior Art FIG. 10
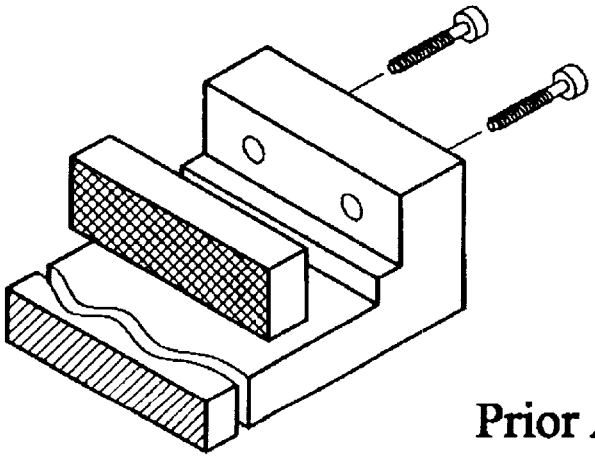
Prior Art FIG. 11

INTEGRAL U-SHAPE CLAMPING BLOCK STRUCTURE

BACKGROUND OF THE INVENTION 1. (a) Field of the Invention

The present invention is related to an integral U-shape clamping block structure, and more particularly, to one that facilitates installation or modification of the clamping block and neck of jaw, provides better combination strength and expands clamping surface width.

2. (b) Description of the Prior Art

The combination of the clamping block and the neck of jaw of the conventional vices is usually achieved by three methods. The first method is as illustrated in FIG. 9, wherein, the neck of jaw is directly screwed to the clamping block; or as illustrated in FIG. 10, additional fixation members are secured together with the neck of jaw to the clamping block; or as illustrated in FIG. 11, the neck of jaw is screwed to the clamping block from its back. In FIG. 9, the surface of the clamping block to receive the neck of jaw must be drilled and thus the clamping surface is damaged. FIG. 10 has a poor strength and when the vices are working sideways, the clamping is vulnerable to the interference from both side fixation members. As for FIG. 11, the drilling is usually very difficult for being subject to the physical shape of the chuck, e.g. the vices on desktop which is provided with curved neck of jaws. Furthermore, blind holes must be provided on the back of the clamping block to keep the clamping surface integral. Consequently, the threading depth is comparatively shallow, thus the sheath strength is comparatively poor.

SUMMARY OF THE INVENTION

The primary purpose of the present invention is to provide an integral U-shape clamping block to ensure the sufficient strength and expanded width of the clamping surface after the clamping block is combined with the neck of jaw to improve clamping capability, and to facilitate the assembly or retrofit of the clamping block and the neck of jaw of a vices. To achieve the purpose, an integral fixation arm extending rearward is provided to both sides of the body of the clamping block and locking holes and screws are provided sideways to the fixations arm.

BRIEF DESCRIPTION OF THE DRAWINGS

FIG. 9 is a conventional combination illustration of screwing the clamping block to the neck of jaw frontally.

FIG. 10 is a conventional combination illustration of securing the clamping block to the neck of jaw by lateral fixation members.

FIG. 11 is a conventional combination illustration of screwing the clamping block to the neck of jaw from its back.

DETAILED DESCRIPTION OF THE PREFERRED EMBODIMENTS

The present invention related to an integral U-shape clamping block to ensure the sufficient strength and expanded width of the clamping surface after the clamping block is combined with the neck of jaw to improve clamping capability, and to facilitate the assembly or retrofit of the clamping block and the neck of jaw of a vices by having an integral fixation arm extending rearward is provided to both sides of the body of the clamping block and locking holes and screws are provided sideways to the fixations arm.

A specific, integral U-shape clamping block of the present invention is provided with a structure to facilitate the installation or retrofit of the clamping block and the neck jaw to yield excellent strength and expand the width of the clamping surface.

Figure 1:
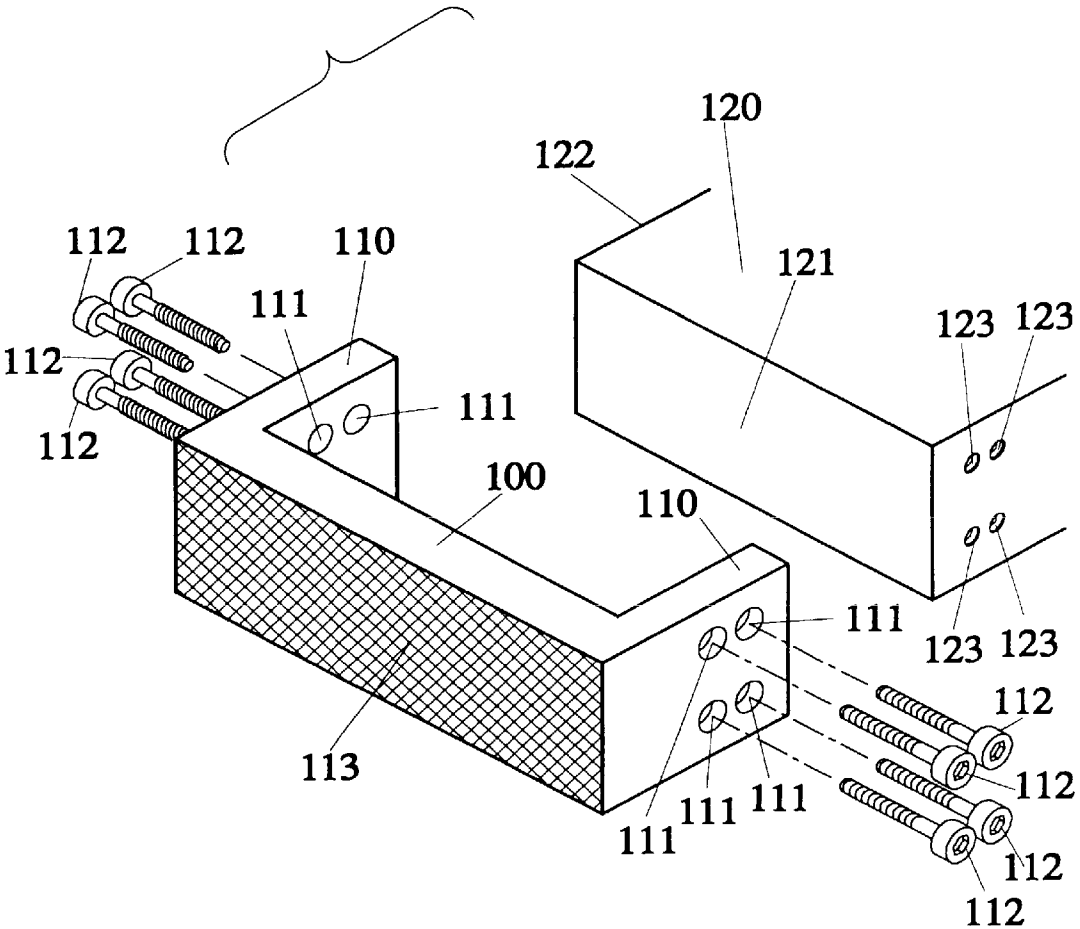
FIG. 1 is a perspective view of an integral U-shape clamping block structure of the present invention applied in a flat clamping jaw.
Figure 2:
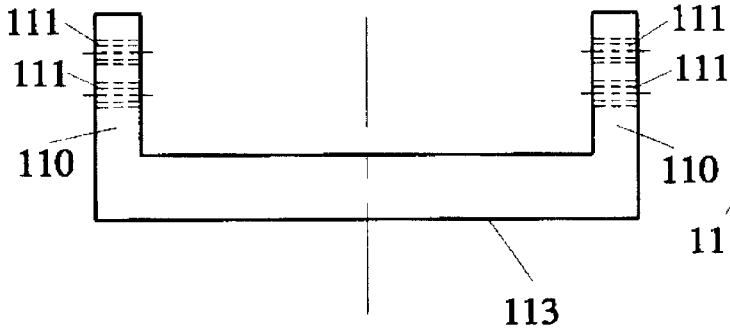
FIG. 2 is a bird's view of FIG. 1.
Figure 4:
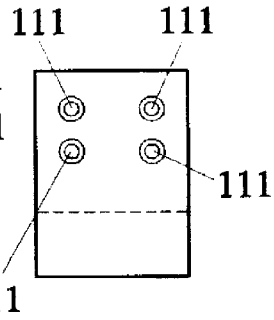
FIG. 4 is a side view of FIG. 1.
Figure 3:
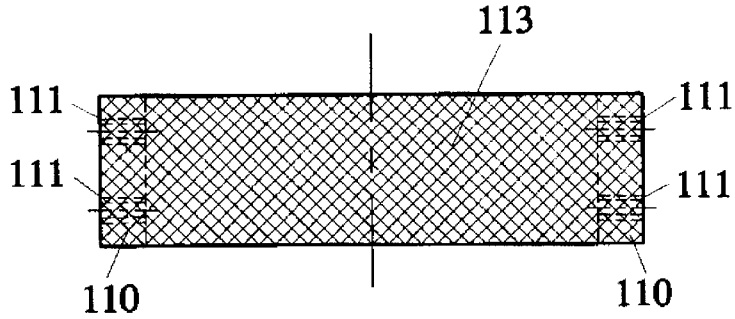
FIG. 3 is a front view of FIG. 1.

FIG. 1 shows a perspective view of an integral U-shape clamping block structure of the present invention applied in a flat clamping jaw. FIG. 2 is a bird's view; FIG. 3, the front view and FIG. 4, the side view of the first preferred embodiment, characterized by that:

a clamping block 100: made of selected metal or other type of material indicating an integral U-shape structure; having its clamping surface 113 to clamp a work piece; the surface may be in the form of straight flat, toothed, provided with multiple vertical or a horizontal V-shape grooves or provided with a mobile claw or jigs to firmly clamp the work piece; both sides of the clamping block 100 are each provided with a clamping arm 110 extending rearward, each of the clamping arm is drilled with multiple holes 111 in a certain number as required to receive the fixation screws 112 to secure the clamping block 100 to a neck 120 of jaw; and the neck 120 of jaw: made of selected metal or other type of materials with its clamping surface provided with a passive coupling surface 121 and both side of the neck of jaw provided with each a fixation surface 122 to accommodate the clamping block 100 and secured with those fixation screws 122 into multiple screw holes 123 of the same number of that of the fixation holes 111 that are provided each of both sides of the neck 120 of jaw, thus to secure the clamping block 100 to the coupling surface 121 on the neck 120 of jaw;

Said clamping structure comprised of the block 100 and the neck 120 of jaw may be made of one set, two sets, or more than two sets of the block 100 and the neck 120 of jaw to be driven by force to relatively clamp or release the work piece.

Figure 5:
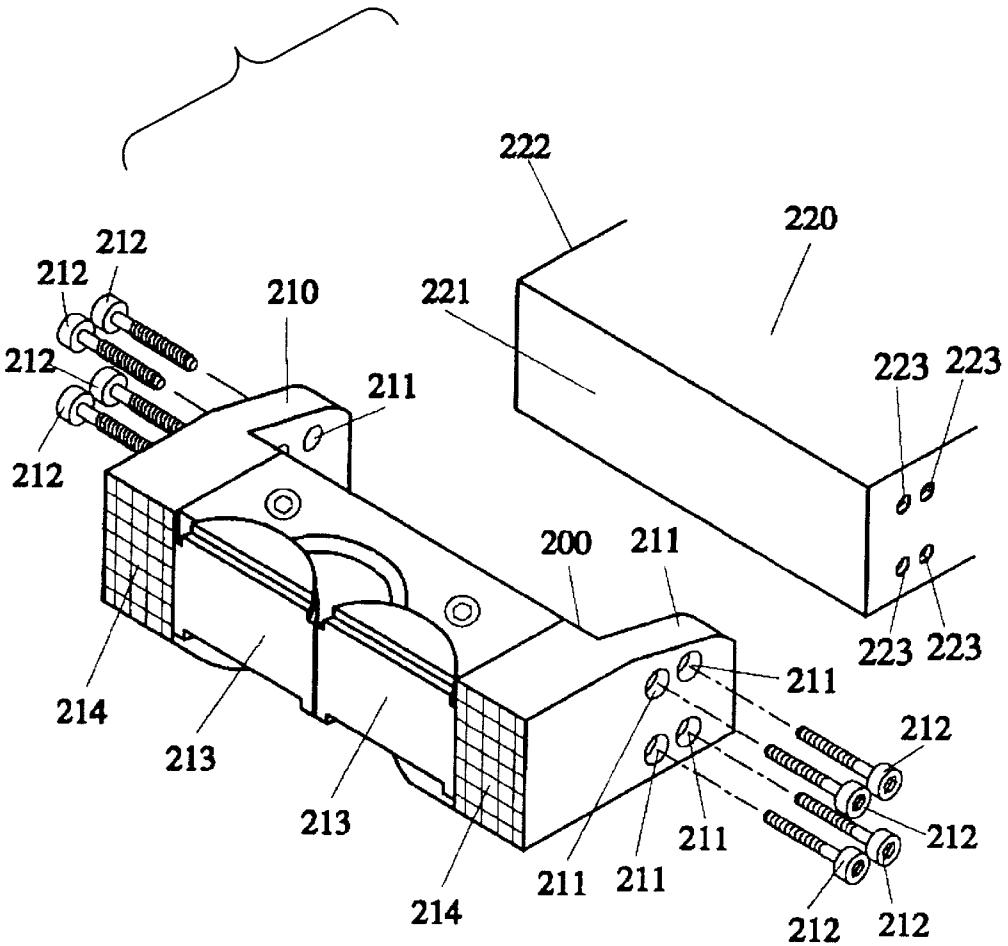
FIG. 5 is a perspective view of an integral U-shape clamping block structure of the present invention applied in a mobile clamping jaw.
Figure 6:
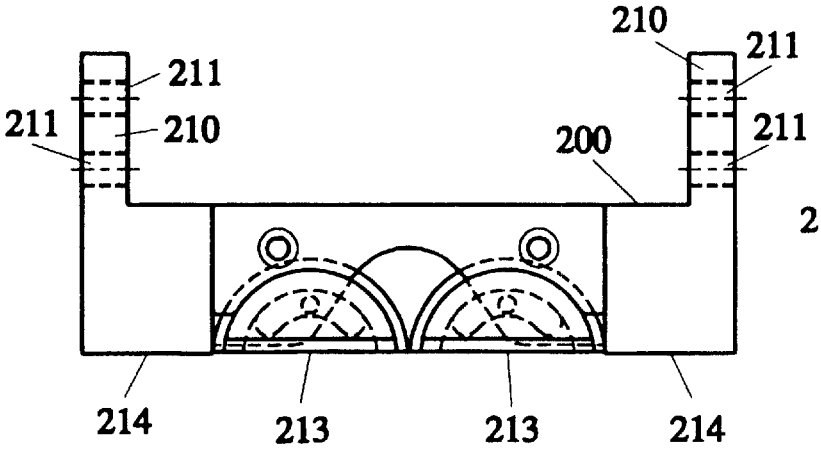
FIG. 6 is a bird's view of FIG. 5.
Figure 8:
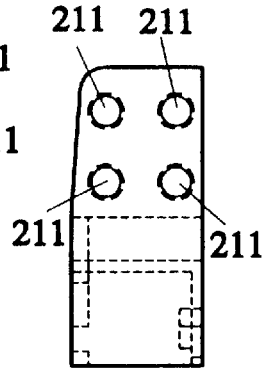
FIG. 8 is a side view of FIG. 5.
Figure 7:
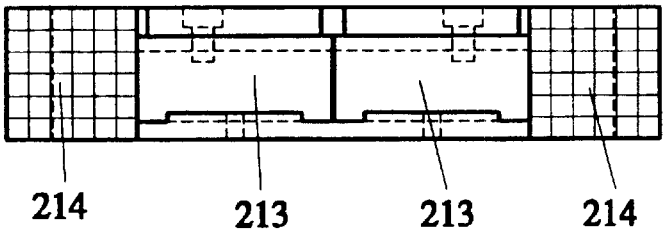
FIG. 7 is a front view of FIG. 5.

FIG. 5 shows a perspective view of a second preferred embodiment of the present invention applied to a clamping block provided with a mobile claw. FIG. 6 is a bird's view; FIG. 7, the front view and FIG. 8, the side view of the second preferred embodiment, characterized by that:

a clamping block 200: made of selected metal or other type of material indicating an integral U-shape structure; having its clamping surface provided with a mobile claw 213 to clamp a work piece, and optionally an auxiliary clamping block 214 respectively to both external ends of the mobile claw to clamp a work piece in various forms; both sides of the clamping block 200 are each provided with a clamping arm 210 extending rearward, each of the clamping arm is drilled with multiple holes 211 in a certain number as required to receive the fixation screws 212 to secure the clamping block 200 to a neck 220 of jaw; and the neck 220 of jaw: made of selected metal or other type of materials with its clamping surface provided with a passive coupling surface 221 and both side of the neck of jaw provided with each a fixation surface 222 to accommodate the clamping block 200 and secured with those fixation screws 212 into multiple screw holes 223 of the same number of that of the fixation holes 211 that are provided each of both sides of the neck 220 of jaw, thus to secure the clamping block 200 to the coupling surface 221 on the neck 220 of jaw;

Said clamping structure provided with a mobile claw comprised of the block 200 and the neck 220 of jaw may be made of one set, two sets or more than two sets of the block 200 and the neck 220 of jaw to be driven by force to relatively clamp or release the work piece.

As disclosed above, the present invention when compared to the conventional combination of jaw and neck of jaw, providing better secured clamping and is easier to produce for cost saving and precise function is innovative. Therefore, the application for utility pattern is duly filed accordingly.

What is claimed is:

1. A U-shaped clamping block for mounting on a jaw member of a vise, the jaw member having a coupling surface, and two fixing surfaces in which a plurality of female threaded holes are formed, the two fixing surfaces being spaced apart from each other by a first distance, the clamping block comprising:

a clamping body having a clamping surface adapted to be larger in area than the coupling surface, and having a plurality of grooves arranged over an entire face of the clamping surface;

two clamping arms, each being disposed directly behind and extending away from the clamping surface at a respective end side of the clamping body so that the clamping body and clamping arms form a U-shape, each clamping arm having a plurality of through holes formed thereon, each clamping arm having an outermost free end, with each clamping arm, from the respective outermost free ends to the clamping body, and as measured from an inside surface of the respective clamping arms, being spaced apart from the other clamping arm by a second distance that is greater than the first distance, thereby allowing the clamping block to be positioned on the jaw member by placing the clamping body directly in front of the coupling surface, and moving the clamping body toward the coupling surface until the clamping body and the coupling surface touch; and a plurality of threaded fasteners insertable through the through holes, and being threadable into the female threaded holes so that the clamping body and the clamping arms closely contact with the coupling surface and the fixing surfaces, respectively.

2. A U-shaped clamping block for mounting on a jaw member of a vise, the jaw member having a coupling surface, and fixing surfaces in which a plurality of female threaded holes are formed, the clamping block comprising:

a clamping body having a first clamping surface adapted to be larger in area than the coupling surface, and including a mobile claw having a second clamping surface, and an auxiliary clamping piece having a third clamping surface on which a plurality of grooves are arranged over an entire face thereof, the second clamping surface and the third clamping surface collectively defining the first clamping surface;

two clamping arms, each being disposed directly behind and extending away from the third clamping surface at a respective end side of the clamping body so that the clamping body and clamping arms form a U-shape, each clamping arm having a plurality of through holes formed thereon; and a plurality of threaded fasteners insertable through the through holes, and being threadable into the female threaded holes so that the clamping body and the clamping arms closely contact with the coupling surface and the fixing surfaces, respectively.

* * * * *